US011566486B2

(12) United States Patent
Assal

(10) Patent No.: US 11,566,486 B2
(45) Date of Patent: Jan. 31, 2023

(54) TRANSFORMING BRIDGE-TO-FLOW-THROUGH FRAC PLUG

(71) Applicant: Anwar Ahmed Maher Abdelaziz Assal, Dubai (AE)

(72) Inventor: Anwar Ahmed Maher Abdelaziz Assal, Dubai (AE)

(73) Assignee: FRAC MASTER FZ-LLC, Ras Al Khaimah (AE)

( * ) Notice: Subject to any disclaimer, the term of this patent is extended or adjusted under 35 U.S.C. 154(b) by 0 days.

(21) Appl. No.: 17/083,285

(22) Filed: Oct. 28, 2020

(65) Prior Publication Data

US 2021/0123321 A1 Apr. 29, 2021

Related U.S. Application Data

(60) Provisional application No. 62/926,859, filed on Oct. 28, 2019.

(51) Int. Cl.
*E21B 33/129* (2006.01)
*E21B 33/12* (2006.01)
*E21B 23/01* (2006.01)

(52) U.S. Cl.
CPC ..... *E21B 33/1293* (2013.01); *E21B 23/01* (2013.01); *E21B 33/1204* (2013.01); *E21B 2200/08* (2020.05)

(58) Field of Classification Search
CPC .. E21B 33/1292; E21B 33/1293; E21B 23/01; E21B 2200/08; E21B 33/134
See application file for complete search history.

(56) References Cited

U.S. PATENT DOCUMENTS

2007/0029095 A1* 2/2007 Brisco ..... E21B 43/103 166/380
2011/0232899 A1* 9/2011 Porter ..... E21B 33/1292 166/181
2019/0144733 A1* 5/2019 Fripp ..... E21B 33/134 166/387

* cited by examiner

*Primary Examiner* — D. Andrews
*Assistant Examiner* — Ronald R Runyan

(57) ABSTRACT

A transforming bridge-to-flow-through frac plug has a mandrel, a retaining sleeve, a pair of cones, a pair of slips, a packing element, and a keeper ring. The mandrel is concentrically connected within the retaining sleeve, and is constructed of a dissolvable material such that the mandrel is dissolvable through application of a solvent in order to form a big bore flow-through frac plug if removal of the frac plug by milling is not possible. The pair of cones, pair of slips, packing element, and keeper ring are positioned on the exterior of the retaining sleeve in order to secure the frac plug in place after a setting operation, even if the mandrel is dissolved in order to form the big bore flow-through frac plug.

11 Claims, 5 Drawing Sheets

Run in Hole Position

Run in Hole Position

Setting the Plug

Plug set, Mandrel sheared, wireline adapter kit and setting tool released

Milling to Remove

Dissolving to Remove

TRANSFORMING BRIDGE-TO-FLOW-THROUGH FRAC PLUG

The current application claims a priority to the U.S. Provisional Patent application Ser. No. 62/926,859 filed on Oct. 28, 2019.

FIELD OF THE INVENTION

The present invention relates generally to hydraulic fracking. More particularly, the present invention relates to hybrid frac plugs.

BACKGROUND OF THE INVENTION

As an industry response, technologies based on dissolvable materials of ball drop isolation flow-through or full dissolvable plugs have emerged as preferred solutions for increasing efficiencies and reducing self-isolated plugs milling operational risks. Nevertheless, these technologies are only partial solutions and often have major components that are not capable of being dissolved, having only incomplete dissolution. In addition, these technologies are not qualified for applications exceed 10,000 psi pressure or 300 F temperature and can be difficult to remove in the event of a pre-set, or after stimulation in case a later intervention is needed in the well.

The new invention enables oil and gas operating companies to transform HPHT Solid-Core Frac Plug to Flow-through Big-Bore Plug using Activated Dissolving Solid-Core Materials Frac Plug will be developed to solve the problems mentioned above. This new innovative method relies on temporary bi-directional self-isolating solid core is made of material soluble in acid or activation chemical to avoid the need to mill out plugs after fracturing all stages.

Prior to and During fracturing, the new invention allows the fully isolation of the previous fractured stage. After all stages are stimulated, the Dissolving Solid-Core Materials self-isolation assemblies (of HPHT plugs) are removed by simple contact with chemical is spotted on top of plugs after fracturing during the coil tubing clean out trips; no mechanical remediation is needed. Immediate production is possible, and the well is left with a full-bore ID. The ultimate production potential of the reservoir can be achieved as the self-isolation assembly degrades away, leaving no restrictions in the temporary self-isolation plugs that can allow production through a big bore.

This invention will drastically reduce the CT milling intervention cost to the operating companies by utilizing the most efficient methodology that will integrate, pre-frac self-isolation and post-frac flow-through features and benefits, to create a step change in the plug and perf technique.

In multi-zones/layers unconventional and conventional reservoirs, the plug and perf technique is the most common application used in completions of vertical or horizontal wells that require multistage hydraulic fracturing.

Once the oil/gas well is drilled, cased, cemented and isolated—two runs of coiling tubing will be required. The first coil tubing run will be to clean up residual cement and the second run to convey the first set of perforating guns to the end of the well or toe. This is called the "Toe Prep". Once the perforating guns are initiated and perforated holes through the casing and cement into the formation, fluids can now be pumped into the formation. The coil tubing is pulled out of the well bore and the pressure pumping crew (frac crew) will rig up and begin to fracture the first stage of the job. In all frac plugs design cases, an electric or electronic signal is sent through the wireline to the setting tool (igniter) in order to activate the setting tool and set the frac plug of the sequential frac stages.

Once the plug is set in place—the setting tool will release from the plug and move up the hole (single run) or out of the hole (multiple runs), and perforating guns will be positioned to the depth of the first set of perforations, another electric/electronic signal is sent through the wireline to activate the perforating gun. This process is repeated until all guns for this stage are initiated.

After the perforations have been fired, wireline will pull out of the hole for the crew to rig down. Next, the pressure pumping crew will rig up to prepare for the second stage frack job—the process of completing a stage is then repeated by setting a plug to isolate from the previously fractured stage and new perforations are added per the completion design. The entire stage process will be repeated until all zones along the reservoir sections of the well bore are fracture stimulated and the well bore is completed.

The number of frac stages and number of guns per stage, will be determined by the frac or completion design. Many different frac plugs options exist such as solid core self-isolation plugs, one-way ball/flapper valve flow-through plugs, will be used depending on the following basis of design criteria; reservoirs pay zones lengths, completion fluids weight, formations pressure, operations sequence (single run plug and perf vs multiple runs).

The present invention solves the following problems: after all the stimulation stages are concluded, solid-core self-isolating plug removal is necessary to enable production. A milling assembly must then be passed into the well, usually by coiled tubing, to remove the restrictions used during the stimulation. The inherent need for coiled tubing when using plug and perforate technique limits the process itself. This costly operation is required at the end of every well, as well as every time that a plug unintentionally pre-sets. In addition, on long horizontal wells, plug conveyance may be possible, but plug removal may not be possible. This is also true for wells with low reservoir pressure, where the risk of milling out plugs increases significantly and in some other cases the casing above plugs collapsed and restrict the accessibility to reach out the plugs with the milling tool.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

Figure 1:
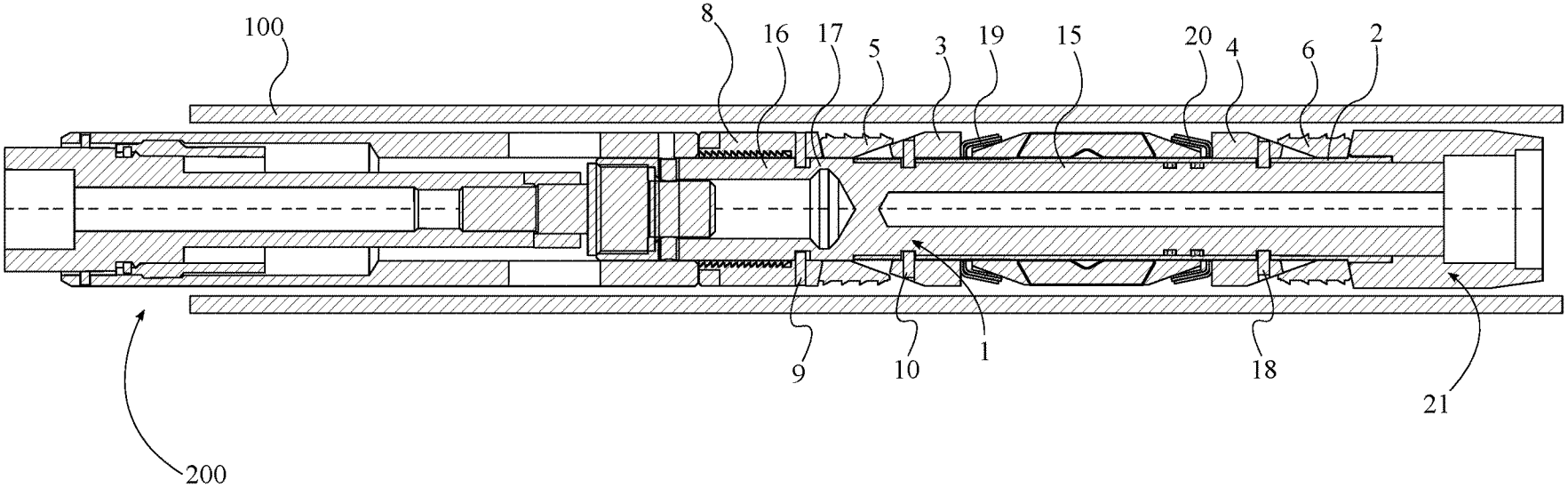
FIG. 1 is a side schematic view of the present invention attached to a setting tool in a run-in hole position.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

A "frac plug" herein refers to a tool used to permanently or temporarily isolate one wellbore zone from another, including any tool with blind passages or plugged mandrels, as well as open passages extending completely there through and passages blocked with a check valve. Such tools are commonly referred to in the art as "bridge plugs," "frac plugs," and/or "packers." Frac plugs can be a single assembly (i.e., one plug) or comprise two or more assemblies (i.e., two or more plugs) disposed within a work string or otherwise connected and run into a wellbore on a wireline, slickline, production tubing, coiled tubing or any technique known or yet to be discovered in the art.

The frac plug of the present invention is a mechanical plug which is designed for multi-stage hydraulic fracturing stimulation of conventional or unconventional cemented fracking applications. The present invention is run and set on conventional Wireline Pressure Setting Tool assembly (WLPSTA) as with other typical frac plugs on the market.

The purpose of the present invention is to develop a new frac plug that is capable of transforming from a temporary solid-core bi-direction isolation plug prior to and during frac operations to a full-bore flow-through production plug post frac operations. The present invention will enable oil and gas operating companies to frac wells that combine high pressure zones and low-pressure depleted zones utilizing the multi-stage plug and perf technique without encountering difficulties validating the flow-through frac plugs pressure integrity in high pressure zones being completed with underbalance fluid hydrostatic pressure. The well's post completion installations utilize rig-less through-tubing perforating guns conveyed on E-line, slickline or coiled tubing, etc.

Currently, frac plugs exist which are suitable for high temperature, high pressure (HTHP) applications due, but are not dissolvable as is the present invention. Furthermore, dissolvable frac plugs are currently known in the art, but are generally unsuitable for HTHP applications as dissolvable materials currently known in the art have material properties insufficient to withstand HTHP conditions. HTHP conditions may be understood to include, but are not limited to, for example, approximately 10,000 psi and 300 degrees Fahrenheit or more.

The invention discloses a new transforming frac plug, which is installed as a temporary solid-core bi-direction isolation plug that enables oil and gas operating companies to positively and negatively pressure test the wells prior to perforate the target stage "underbalanced", then frac the target stage, then transform the frac plug to a full-bore flow-through production plug post frac operation. The new frac plug of the present invention is able to transform into a full-bore flow-through production plug by applying a dissolving substance to the frac plug of the present invention, which dissolves a mandrel of the frac plug, leaving behind a flow-through bore through a retaining sleeve, which is not similarly dissolvable to the mandrel. The retaining sleeve, however, is millable, along with all the remaining components of the present invention. Thus, the operators of a fracking site utilizing the frac plug of the present invention are enabled to remove the flow obstruction provided by the frac plug once the fracking process is completed.

Figure 2:
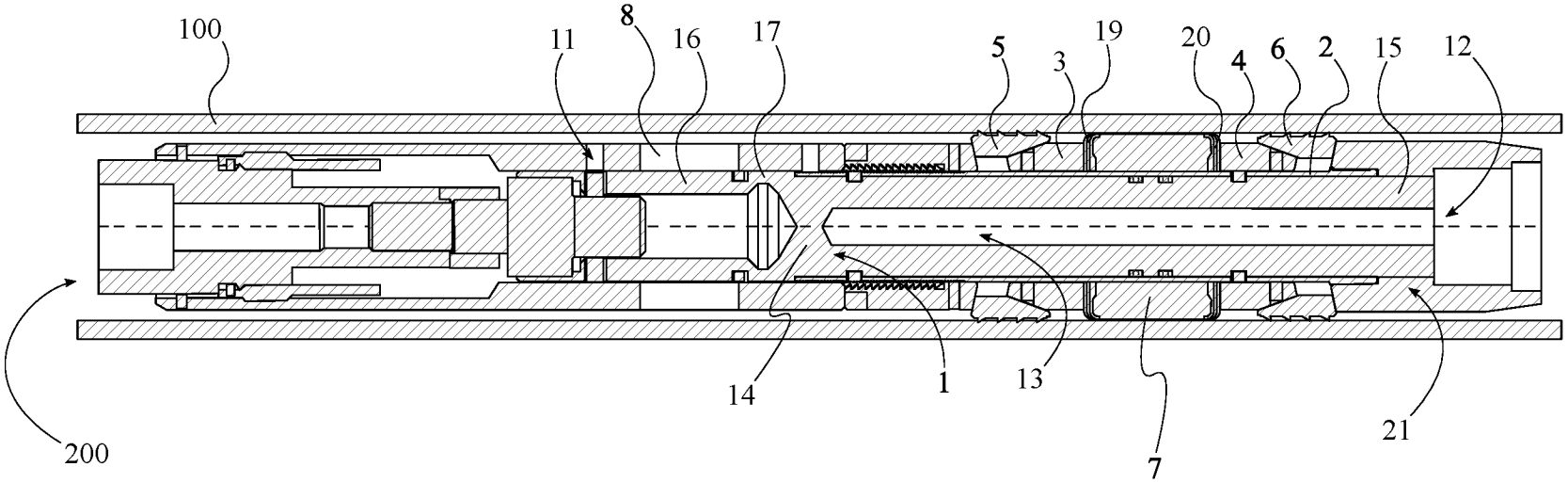
FIG. 2 is a side schematic view of the present invention attached to a setting tool during a plug setting operation.
Figure 3:
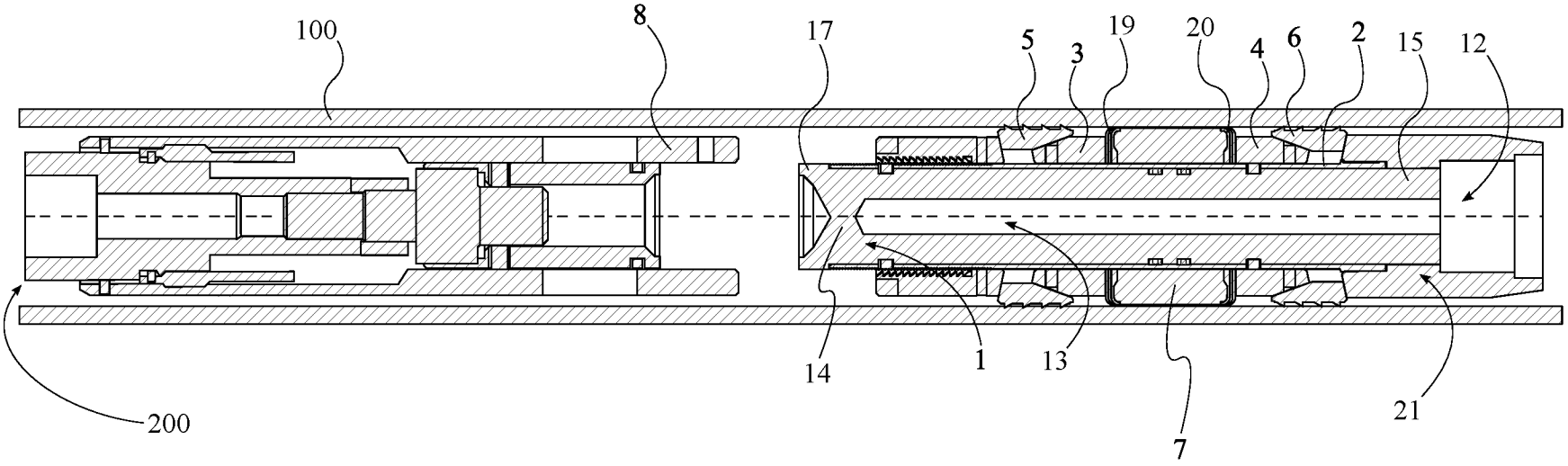
FIG. 3 is a side schematic view of the present invention after being set and detached from the setting tool.
Figure 4:
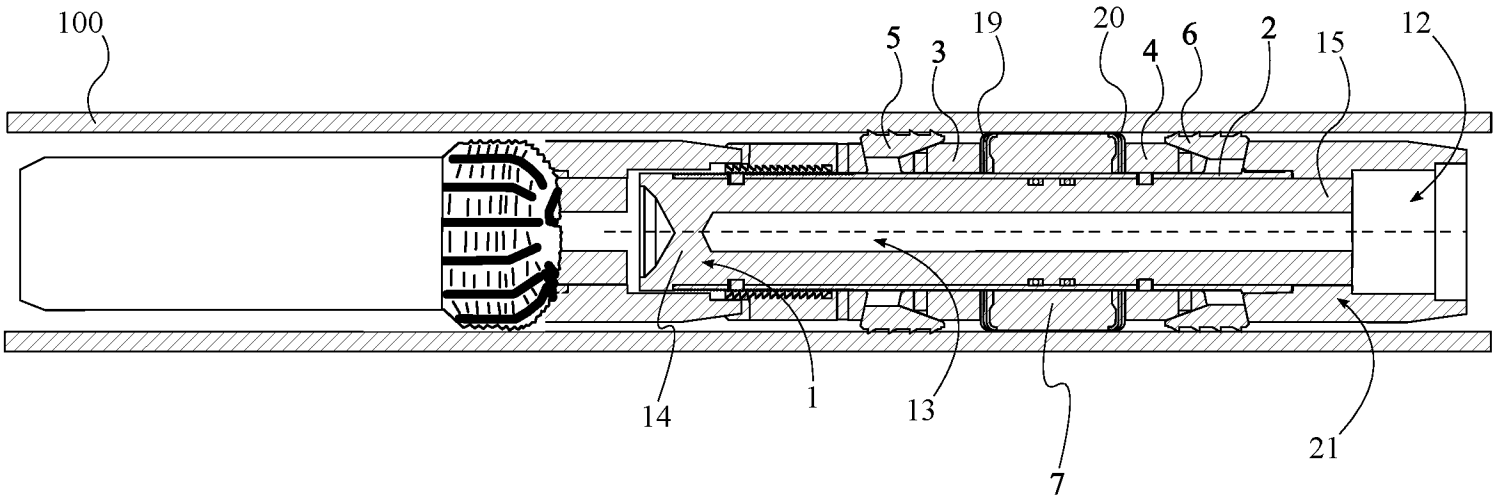
FIG. 4 is a side schematic view of the present invention illustrating a million operation to remove the present invention after use.
Figure 5:
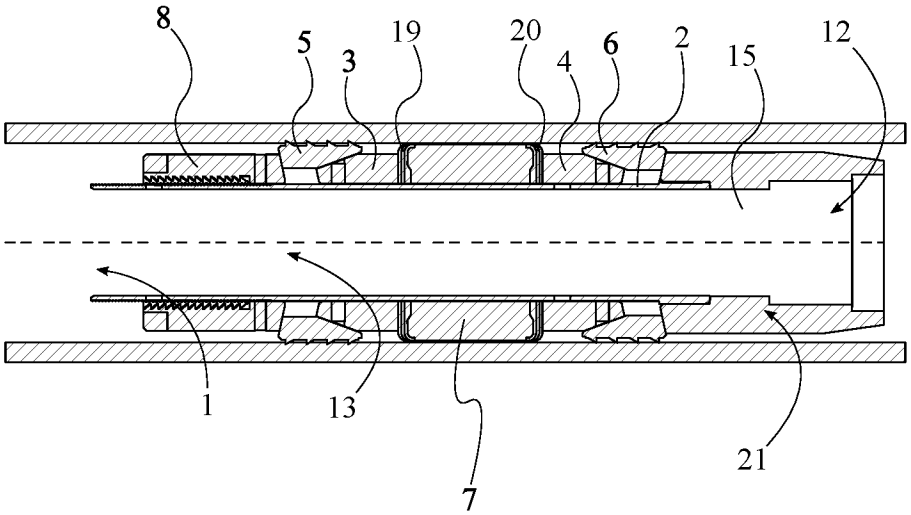
FIG. 5 is a side schematic view of the present invention illustrating the present invention in a big-bore flow-through configuration after the mandrel has been dissolved.

Referring to FIGS. 1-5, in general, the present invention comprises a mandrel 1, a retaining sleeve 2, an upper cone 3, a lower cone 4, an upper slip 5, a lower slip 6, a packing element 7, and a keeper ring 8. Generally, since fracking wells are drilled out to a circular cross section, each of the components of the present invention may be understood to have radial geometry and are longitudinally positioned relative to each other concentrically about a central axis.

A traditional composite frac plug contains a mandrel, upper slip/cone, element, and lower slip/cone. The mandrel provides the main structure of the frac plug that the remaining components "ride" on and will either have profiles machined into it or have additional parts attached to constrain the components during run in, setting, and frac.

In the preferred embodiment of the present invention, the mandrel 1 is concentrically connected within the retaining sleeve 2. In the preferred embodiment, the retaining sleeve 2 is generally a simple cylindrical structure and may comprise holes for receiving pins or other connecting members in order to affix other components of the present invention to the retaining sleeve 2.

The mandrel 1 is concentrically connected within the retaining sleeve 2, which encases the majority of the axial length of the mandrel 1. In the preferred embodiment of the present invention, the mandrel 1 comprises a proximal end 11, a distal end 12, a bore 13, and a partition 14. The mandrel 1 traverses between the proximal end 11 and the distal end 12, and the bore 13 axially traverses through the mandrel 1.

Moreover, in the preferred embodiment of the present invention, the mandrel 1 is constructed of a dissolvable material, wherein the mandrel 1 is dissolvable through application of a solvent in order to form a flow-through bore 13 axially traversing through the retaining sleeve 2, which is left behind after dissolution of the mandrel 1 in addition to the upper cone 3, lower cone 4, upper slip 5, lower slip 6, packing element 7, and keeper ring 8, which are all supported by the retaining sleeve 2 between the retaining sleeve 2 and the casing 100 of the well the frac plug of the present invention is installed into.

The specific dissolvable material of the mandrel 1 may vary in different embodiments as desired, so long as the choice of dissolvable material of the mandrel 1, choice of material of the remaining components of the present invention, and choice of solvent enable the mandrel 1 to be dissolved by the solvent while leaving behind the retaining sleeve 2, upper cone 3, lower cone 4, upper slip 5, lower slip 6, packing element 7, keeper ring 8, and any other relevant components which may be present in different embodiments. For example, in some embodiments, the mandrel 1 may be constructed of an acid-dissolvable material, such as, but not limited to, an aluminum alloy, in which case the solvent applied down the wellbore may be an acidic material, chemical, or compound, such as, but not limited to, hydrogen chloride (HCl). In some embodiments, the mandrel 1 may be constructed of a brine-dissolvable material, such as, but not limited to, a magnesium alloy, in which case the solvent conveyed down the wellbore to the frac plug of the present invention may be brine, potassium chloride (KCl), fluids with high CO2 content, or other suitable fluids. In some embodiments, the mandrel 1 may be constructed of polyglycolic acid (PGA), another degradable material known in the art. It should be readily understood that the material selection for any of the various components of the present invention should not be limited to any specific material, and a wide range of materials may conceivably be chosen to suit the spirit and purpose of the present invention.

Various components of the present invention may comprise various metals alloyed together, such as, but not limited to, aluminum, magnesium, silicon, copper, lithium, manganese, zinc, indium, or the like. Such alloys may increase the strength of the elements relative to unalloyed aluminum elements or increase rate of dissolution in the wellbore relative to unalloyed aluminum. The retaining sleeve 2, upper cone 3, lower cone 4, upper slip 5, lower slip 6, packing element 7, and keeper ring 8 are constructed of a high strength, yet millable material as is currently known in the art. For example, the upper slip 5 and lower slip 6 may be constructed of, but not limited to, aluminum, cast iron, ceramic, composite, tungsten carbide, or any combination thereof or not specifically disclosed herein. As previously mentioned, the retaining sleeve 2, upper cone 3, lower cone 4, upper slip 5, lower slip 6, packing element 7, and keeper ring 8, in addition to any other components not herein listed, should be constructed of a material suitable to withstanding HTHP applications of approximately 10,000 psi and/or 300 degrees Fahrenheit or more.

In the preferred embodiment of the present invention, the packing element 7, the upper cone 3, the lower cone 4, the upper slip 5, and the lower slip 6 are concentrically positioned around the retaining sleeve 2. The upper cone 3 is positioned axially adjacent to the packing element 7. The lower cone 4 is positioned axially adjacent to the packing element 7 opposite the upper cone 3. The upper slip 5 is positioned axially adjacent to the upper cone 3 opposite the packing element 7, and similarly the lower slip 6 is positioned axially adjacent to the lower cone 4 opposite the packing element 7. This arrangement of upper and lower slip 6*s* and cones is well known in the art. Furthermore, the keeper ring 8 is positioned concentrically around the mandrel 1 axially adjacent to the upper slip 5.

The slips are designed to interact with the cones such that when forced together the slips move outward to touch the casing 100. The slips will have hardened edges that are designed to "bite" into the casing 100, locking them in place. The slips will be a full ring or individual segments that are held together with a band. Either way, the slips are designed to stay together until the setting sequence breaks them apart allowing them to move up the cone and set into the casing 100.

To further facilitate the spirit of the present invention, in the preferred embodiment, the mandrel 1 further comprises a main section 15, a shearing section 16, and a shearing interface 17. The shearing interface 17 is positioned axially adjacent to the partition 14 opposite the bore 13. The shearing section 16 is terminally connected axially adjacent to the main section 15 through the shearing interface 17, and the shearing section 16 is configured to engage with a setting tool 200 axially opposite the main section 15 along the shearing section 16. Moreover, the bore 13 traverses through the main section 15 from the partition 14 through the distal end 12 of the mandrel 1. The shearing section 16 is designed to break away from the main section 15 at the shearing interface 17, which is a section of the mandrel 1 with reduced wall thickness to facilitate the shearing action. The purpose of the shearing section 16 is to allow disconnection of the setting tool 200 from the frac plug, in addition to providing a location to support the keeper ring 8 before the frac plug is set, at which time the keeper ring 8 is displayed axially toward the distal end 12 by an axial force applied to the keeper ring 8 by the setting tool 200.

In the setting operation, the keeper ring 8, being positioned axially adjacent to the upper slip 5, is forced against the upper slip 5, causing a collective compression of the upper slip 5, upper cone 3, packing element 7, lower cone 4, and lower slip 6. This compressive action causes the slips to slide up a ramped surface of the cones, radially outward in order to securely engage the slips against the casing 100 of the wellbore, wherein the slips each have a "toothed" or similar configuration on their outer surface as known in the art in order to engage the casing 100. In addition to the outward engagement of the slips into the casing 100, the packing element 7 is axially compressed with a corresponding radial expansion, causing the packing element 7 to come into contact with the casing 100, providing additional security along the casing 100 through friction, as is well known in the art.

Furthermore, the preferred embodiment of the present invention further comprises a first shear pin 9, a second shear pin 10, and a third shear pin 18. The first shear pin 9 traverses through the keeper ring 8 into the shearing section 16 of the mandrel 1 adjacent to the shearing surface. The first shear pin 9 holds the keeper ring 8 in place before the setting operation, during which the first shear pin 9 is broken as the keeper ring 8 is displaced down the exterior of the frac plug of the present invention. The second shear pin 10 traverses through the upper cone 3 and the retaining sleeve 2 into the main section 15 of the mandrel 1. Similarly, the third shear pin 18 traverses through the lower cone 4 and the retaining sleeve 2 and into the main section 15 of the mandrel 1. The second shear pin 10 and the third shear pin 18 hold the upper cone 3 and the lower cone 4 in place, respectively, axially along the exterior of the retaining sleeve 2 until the setting operation, when they are sheared apart, releasing the connection between the cones and the retaining sleeve 2, due to the aforementioned compressive setting action.

Preferably, the present invention further comprises an upper backup 19 and a lower backup 20. Many traditional plugs on the market will include a backup system for the packing element 7 that is designed to expand with the element as it is set and then provide structure to keep the element in place during the high-pressure phase of the frac. The upper backup 19 is positioned axially between the upper cone 3 and the packing element 7, while the lower backup 20 is positioned axially between the lower cone 4 and the packing element 7. Furthermore, the preferred embodiment of the present invention further comprises a bottom sub 21 as known in the art. The bottom sub 21 is concentrically connected around the distal end 12 of the mandrel 1, and the bottom sub 21 is positioned axially adjacent to the lower slip 6 opposite the lower cone 4. Moreover, the bottom sub 21 is attached around the distal end 12 of the mandrel 1 through a left-handed thread connection in order to maintain the connection between the bottom sub 21 and the mandrel 1 while milling.

In summary, the present invention presents a dual use frag plug suitable for high pressure, high temperature application. During normal use, the present invention will function as a solid core bi-directional self-isolating frac plug which will ordinarily be milled to remove, but also presents the option to dissolve the mandrel 1 in order to create a full-bore flow-through production plug as a contingency, in case the casing 100 collapses or the frac plug is not reachable with a milling tool. This new innovative plug relies on a temporary bi-directional isolating mandrel 1 made of high strength material that is soluble in HCL acid or dissolvable Brine, with non-dissolvable external parts. The present invention features bi-directional sealing, easy to mill alloy slips, multiple dissolvable mandrel alloy options, and a big bore inner diameter (ID) after transformation. The present invention is suitable for HPTP live wells, under-balance perforations, stage back flow testing, and extended reach wells. The user is enabled through the present invention to individually test multi-zone reservoirs. Preferably, the present invention is also short in length and thus easy to mill. Moreover, the inability to reach frac plugs to mill them (CDG deformation or CT reach limitation) is solved by providing the dissolvable mandrel contingency option, resulting in a big bore ID (60% of CSG drift ID).

With the milling to remove option, the present invention's short length provides a quick milling time with very little debris. An interlocking clutch further decreases milling time, and a left-handed thread between the bottom sub 21 and the keeper ring 8 of a subsequent plug keeps them together when milling. When milling multiple plugs stacked together, an upper plug and a lower plug for example, the interlocking clutch system prevents the bottom sub of the upper plug from spinning relative to the lower plug after the upper plug's bottom slip is milled and the bottom sub of the upper plug is free to fall below onto the lower plug. With the dissolving to remove option, the present invention leaves a big bore ID, once the mandrel 1 is dissolved, and locks the keeper ring 8 to the sleeve when set. All components aside from the mandrel 1 are contained between the retaining sleeve 2 and the casing 100 of the wellbore, and the setting force is locked between the two sets of slips holding it together.

The transforming frac plug of the present invention bridges technology gaps by satisfying multiple conditions and needs—operational conditions such as underbalance perforation, live well intervention, positive and negative pressure testing, operations efficiency, and plug removal; challenges such as wellbore pressure being greater than the hydrostatic head of the reservoir, gas being present in the wellbore when the plug is set, gas communication through the plug, milling time, and CDG deformation and CT reach limitation; and needed features such as bi-directional isolation, easy to mill materials, and contingency to flow. All these conditions, challenges, and needs are met with the present invention, whether with an "Assal" embodiment, wherein the mandrel 1 is soluble in acid, or a "Disparu" embodiment, wherein the mandrel 1 is dissolvable in brine.

Individual and Business Demographics that would Use this Invention:

Worldwide multi-stages plug and perf applications for Oil and Gas operating companies.

Description of the Benefits of this Invention to its Users

1. High pressure zones>The completion fluids hydrostatic head (underbalance flowing zone condition):
   a. It will be very difficult and inefficient way to validate a stable pressure test on any type of flow through frac plugs with one-way isolation flappers or balls unless increasing the fluid weight exceeding the reservoir pressures, which is not acceptable by most of operators.
   b. The frac plug of the present invention, which transforms from a temporary solid-core bi-direction isolation plug prior to, and during frac operations to a full-bore flow-through production plug post frac operations will be used in those reservoir zones where flowing reservoir zones must be isolated below the target frac stage to enable operators after setting the plug to bleeding WHP to zero, then fill up the string to surface to perform a successful positive hydraulic and negative inflow pressure tests on the frac plugs prior to underbalance perforating, then fracturing the stage above the frac plug of the present invention.
   c. Spotting the designed chemical to dissolve the temporary bi-directional self-isolation assembly to enable the operators to flow all fractured zones/stages through the transformed flow-through big bore installed frac plugs.
   d. The frac plug of the present invention will eliminate the high cost and high-risk coil tubing milling operation.
2. Low pressure zones<The completion fluids hydrostatic head (Extreme overbalance:
   a. In depleted reservoir stages, operators experience collapsed casing 100 after frac operations that lead to a total production loss of expensively fractured zones as they can't pass through the casing 100 restriction areas to reach the solid-core self-isolated frac plugs depths in order to mill it.
   b. The frac plug of the present invention will be used in those reservoir zones will eliminate the high catastrophic failure of inability to mill the plugs by flowing all fractured zones/stages through the transformed flow-through big bore installed frac plugs.

Although the invention has been explained in relation to its preferred embodiment, it is to be understood that many other possible modifications and variations can be made without departing from the spirit and scope of the invention as hereinafter claimed.

What is claimed is:

1. A transforming bridge-to-flow-through frac plug comprising:

a mandrel;
a retaining sleeve;
an upper cone;
a lower cone;
an upper slip;
a lower slip;
a packing element;
a keeper ring;
a first shear pin;
a second shear pin;
a third shear pin;
the mandrel being concentrically connected within the retaining sleeve;
the mandrel being constructed of a dissolvable material, wherein the mandrel is dissolvable through application of a solvent in order to form a flow-through bore axially traversing through the retaining sleeve;
the mandrel comprising a proximal end, a distal end, a bore, and a partition;
the mandrel axially traversing between the proximal end and the distal end;
the bore axially traversing through the mandrel;

the packing element, the upper cone, the lower cone, the upper slip, and the lower slip being concentrically positioned around the retaining sleeve;

the upper cone being positioned axially adjacent to the packing element;

the lower cone being positioned axially adjacent to the packing element opposite the upper cone;

the upper slip being positioned axially adjacent to the upper cone opposite the packing element;

the lower slip being positioned axially adjacent to the lower cone opposite the packing element;

the keeper ring being concentrically positioned around the mandrel axially adjacent to the upper slip;

the first shear pin traversing through the keeper ring into the shearing section of the mandrel adjacent to the shearing interface;

the second shear pin traversing through the upper cone and the retaining sleeve into the main section of the mandrel; and the third shear pin traversing through the lower cone and the retaining sleeve and into the main section of the mandrel.

2. The transforming bridge-to-flow-through frac plug as claimed in claim 1 comprising:

the mandrel being constructed of an aluminum alloy.

3. The transforming bridge-to-flow-through frac plug as claimed in claim 1 comprising:

the mandrel being constructed of an acid-dissolvable material.

4. The transforming bridge-to-flow-through frac plug as claimed in claim 1 comprising:

the mandrel being constructed of a magnesium alloy.

5. The transforming bridge-to-flow-through frac plug as claimed in claim 1 comprising:

the mandrel being constructed of a brine-dissolvable material.

6. The transforming bridge-to-flow-through frac plug as claimed in claim 1 comprising:

the retaining sleeve, the upper cone, the lower cone, the upper slip, the lower slip, the keeper ring, and the packing element being constructed of a millable material.

7. The transforming bridge-to-flow-through frac plug as claimed in claim 1 comprising:

the mandrel further comprising a main section, a shearing section, and a shearing interface;

the shearing interface being positioned axially adjacent to the partition opposite the bore;

the shearing section being terminally connected axially adjacent to the main section through the shearing interface; and the shearing section being configured to engage with a setting tool axially opposite the main section along the shearing section.

8. The transforming bridge-to-flow-through frac plug as claimed in claim 7 comprising:

the bore traversing through the main section from the partition through the distal end.

9. The transforming bridge-to-flow-through frac plug as claimed in claim 1 comprising:

an upper backup;

a lower backup;

the upper backup and the lower backup being concentrically positioned around the retaining sleeve;

the upper backup being positioned axially between the upper cone and the packing element; and the lower backup being positioned axially between the lower cone and the packing element.

10. The transforming bridge-to-flow-through frac plug as claimed in claim 1 comprising:

a bottom sub;

the bottom sub being concentrically connected around the distal end of the mandrel; and the bottom sub being positioned axially adjacent to the lower slip opposite the lower cone.

11. The transforming bridge-to-flow-through frac plug as claimed in claim 10 comprising:

the bottom sub being attached around the distal end of the mandrel through a left-handed thread connection.

* * * * *